US006486424B2

(12) United States Patent
Beckhausen et al.

(10) Patent No.: US 6,486,424 B2
(45) Date of Patent: Nov. 26, 2002

(54) ELECTRICAL CONTACT MAT WITH DEVICE FOR CLOSED-CIRCUIT PROTECTION

(76) Inventors: Karlheinz Beckhausen, Herbert-Lewin-Str. 13, D-50931 Köln (DE); Jürgen Menz, Heidehofweg 25, D-59858 Köln (DE)

( * ) Notice: Subject to any disclaimer, the term of this patent is extended or adjusted under 35 U.S.C. 154(b) by 0 days.

(21) Appl. No.: 09/832,172

(22) Filed: Apr. 10, 2001

(65) Prior Publication Data

US 2001/0037932 A1 Nov. 8, 2001

(30) Foreign Application Priority Data

Apr. 14, 2000 (DE) ..... 100 18 475

(51) Int. Cl.[7] ..... H01H 3/02
(52) U.S. Cl. ..... 200/85 R; 200/86 R
(58) Field of Search ..... 200/61.54, 86 R; 307/119, 147

(56) References Cited

U.S. PATENT DOCUMENTS 4,324,962 A * 4/1982 Dulen ..... 200/159 B
4,529,959 A * 7/1985 Ito et al. ..... 338/295
5,588,673 A * 12/1996 Green et al. ..... 280/731
5,639,114 A * 6/1997 Margetal et al. ..... 280/728.3
5,642,901 A * 7/1997 Bowman et al. ..... 280/728.3
5,798,703 A * 8/1998 Sakai et al. ..... 340/666
6,072,130 A * 6/2000 Burgess ..... 200/86 R

FOREIGN PATENT DOCUMENTS

EP 0 109 159 5/1984
EP 0 395 784 11/1990

* cited by examiner

*Primary Examiner*—Lincoln Donovan
*Assistant Examiner*—Lisa N. Klaus
(74) *Attorney, Agent, or Firm*—Charles L. Schwab; Nexsen Pruet Jacobs & Pollard, LLC

(57) ABSTRACT

Electrical contact mat (2) with at least two plates (2*a*, 2*b*) arranged at a spacing from each other in the at-rest condition, which plates are fabricated in particular from rubber or polymers and made electrically conductive by the admixture of conductive substances such as carbon black, graphite, metal powder and the like, the spacing being established by one or more nonconductive spacers, and with a device for closed-circuit protection, which is operatively connected with the plates (2*a*, 2*b*), the spacers being designed as a substantially inelastic interlayer (2*c*), which has openings of such size that the inner surfaces of the plates (2*a*, 2*b*) make mutual contact when the contact mat (2) is under compressive load and thus form the switch of a tactile sensor (1) of the device for closed-circuit protection, the sensor (1) having an electrical connection (3) in parallel with the contact mat (2).

12 Claims, 3 Drawing Sheets

ELECTRICAL CONTACT MAT WITH DEVICE FOR CLOSED-CIRCUIT PROTECTION

TECHNICAL FIELD

This invention relates to an electrical contact mat with at least two conductive plates arranged at a spacing from each other by nonconductive spacers in an at-rest condition. The electrical contact mat is particularly useful in safety devices, warning devices and intrusion protection apparatus.

BACKGROUND OF THE INVENTION

Fabrication of plates of an electrical contact mat from metal is disclosed in a European patent document EP-0109 159 of Minnesota Mining and Manufacturing Company published May 5, 1984. Such contact mats may possibly be suitable for rough service with large switching forces, but they are not advantageous when smaller point loads initiate a contact. What is more, they are not adaptable to uneven surfaces, curvatures and the like.

European patent document EP-0 395 784 of Karlheinz Beckhauser published on Nov. 7, 1990 shows how to fabricate the plates from rubber, plastic and the like and to provide them with spacers. The spacers are designed as bumps, strips or battens and fabricated in one piece with one plate. In this way, plates are obtained that are complicated and thus expensive to fabricate, especially since the plate with spacers must be designed in such a way that the spacers are not conductive but the plate is conductive.

Further, it is generally known to provide an electrical switching mechanism on safety devices in order, for example, to shut off a machine or to actuate a warning device when a switch initiates a switching pulse. So-called closed-circuit protection is carried out in order to detect open circuits, short circuits and the like. Here, besides the switching mechanism, a tactile sensor also has an electrical termination, this electrical termination lying in a closed circuit. Permanently flowing through this electrical termination is a closed-circuit current, which has a constant value if no switching pulse is present. If a short circuit or an open circuit should suddenly occur, it is detected through variation of the constant closed-circuit current. Similarly, the closed-circuit current changes if the switch short-circuits the electrical termination, so that a switching operation can be initiated by this change of known magnitude in the closed-circuit current. Here it is disadvantageous that the current flow through the electrical termination means that a voltage is present across this electrical termination, leading, on the basis of environmental effects prevailing at the place of installation of the electrical termination, to material damage to the components involved and their connection and to further impairment in signal detection. This leads not only to damage to or even failure of the tactile sensor, but also to the necessity of frequent replacement of the sensor, which is undesirable.

Such safety-critical devices, as a rule, are operated in a voltage range that lies below the so-called low-voltage protection value of 42 volts, preferably 12 or 24 volts being employed. Significant material damage phenomena are detectable even at these voltage values, leading to the disadvantages already described, which are most especially safety-critical. Even the use of high-quality materials in the region of the electrical termination, including the electrical connections, has proved not to lead to significant prevention of material damage.

OBJECTS AND SUMMARY OF THE INVENTION

It is an object of the invention to remedy the disadvantages of the contact mats hereinbefore described and to create a contact mat that is simple and inexpensive to fabricate and reacts in a reliable way to small forces. It is a further object of the invention to avoid the disadvantages of the prior devices for closed-circuit protection, such as damages to or failures of the tactile sensor, with inexpensive materials even if the electrical contact mat is used in a moist or wet environment.

According to the invention, the spacers are designed as a substantially inelastic interlayer, which has openings of such size that the inner surfaces of the plates make mutual contact under compressive load and thus form the switch of the tactile sensor of the closed-circuit protection, the plates being designed as thin, preferably pliable and elastic switching elements. The plates preferably have a thickness of 2.5 mm, the non-conductive interlayer, which is preferably designed as a mesh fabric or perforated film of plastic or cotton, having a preferred thickness of 0.5 mm. The openings in an interlayer a mesh fabric preferably have a mesh width of approximately 5 mm. The plates preferably have a Shore hardness of 50 to 65.

If the interlayer, as proposed according to the invention, is made adhesive on both sides, a unitary contact mat can be fabricated with simple resources. An adhesive tape, for example, can be used as edging in order to improve the durability.

It is further proposed, according to the invention, that the plates have bumps or other protrusions arranged at intervals on their surface opposite the interlayer. In this way, the contactability is enhanced, especially if what is applied is more an areal than a point load.

According to the invention, the proposed contact mat is suitable for the formation of a bumper or other safety switching apparatus with large overtravel, force transmission elements then being located next to the contact mat, which force transmission elements are attached to a support element. An elastic superstructure, preferably made of foamed plastic, is provided on the side of the support element opposite the transmission elements. The support element is articulated so that it can move perpendicularly to the contact mat and is made substantially rigid, so that forces on the elastic superstructure lead to the initiation of a contact of the switching mat. On the end toward the contact mat, the transmission elements are made in such a way that they form a small transmission area lying in the range of 10 $mm^2$. If a plurality of transmission elements are arranged, for example, in multiple rows, even an oblique force on the elastic superstructure can lead to reliable initiation of the contact mat. Thus, switching initiation can be varied through the number and configuration of the transmission elements.

In order to insure an articulation of the support element with elastic superstructure, relative to the contact mat, such that the support element can move perpendicularly to the contact mat, the contact mat and the support element can be placed in a frame, the frame enclosing both these elements and holding them against each other with a rim.

The proposed contact mat is also preferably suitable for the formation of a safety edge switch, the contact mat then being made as a contact strip with which a support strip, which is articulated so that it can move perpendicularly to the contact strip, is in contact via transmission elements. The structure is similar to that of the bumper, here the question being not primarily one of large. overtravel but of a particular kind of safety edge switch. The transmission. elements can be fabricated in one piece with the support strip, and the support strip should have a certain flexibility so that contact initiation also takes place as a consequence of a point load.

The proposed contact mat can also be bent into an arch shape and attached at its two ends to a machine, a rolling gate or the like and designed as a safety edge switch. A pressure on the outer jacket of the contact mat bent into an arch shape initiates a switching pulse.

According to the invention, the current flowing in the closed circuit can be varied through loading and unloading of the contact mat, and there are ways of generating the current flowing in the closed circuit such that a voltage of maximally 1 volt is present across the electrical termination.

It has been found that material damages in the region of the tactile sensor, that is, in the region of the contact mat and of the electrical termination including the electrical connections, can be markedly reduced or substantially prevented by working with voltages in the range below 1 volt. The generation of the current flowing in the closed circuit by equipment that causes the voltage applied across the electrical termination to be maximally 1 volt has the advantage that the previous equipment for generating the voltage or the current flowing in the closed circuit can be retained. In particular, it has been found that this voltage in particular makes the electrical contact mat insensitive to moisture and the like.

If the equipment for generating the current flowing in the closed circuit is designed as a:voltage source, then specifying the voltage with allowance for the value of the electrical termination (thus the resistance value if a resistance is used as the electrical termination) sets the current flowing in the closed circuit and simultaneously limits the voltage across the electrical termination to the maximum value of 1 volt.

If the equipment for generating the current flowing in the closed circuit is designed as a current source, which imposes in the electrical termination of the tactile sensor a current from which the voltage of maximally 1 volt results, then the maximum voltage of 1 volt (or a constant value lying below 1 volt) can be maintained by appropriate dimensioning of the imposed current and the value (resistance value) of the electrical termination (resistance).

In development of the invention, a tactile sensor may be connected to an electronic interpretation unit that has at least one trigger as well as one switching stage. In this way, a compact interpretation unit can be achieved, which not only detects an obstruction using the tactile sensor but also uses the trigger for interpretation and uses a switching stage to initiate a switching operation.

In development of the invention, the equipment (voltage source or current source) is arranged internally or externally to the electrical interpretation unit. In this way, the place of installation of the equipment for generating the current flowing in the closed circuit can be freely chosen and adapted to the prevailing design circumstances.

BRIEF DESCRIPTION OF THE DRAWINGS

Exemplary embodiments of the invention are illustrated in simplified form in the accompanying drawings, in which.

DETAILED DESCRIPTION OF THE INVENTION

Figure 1:
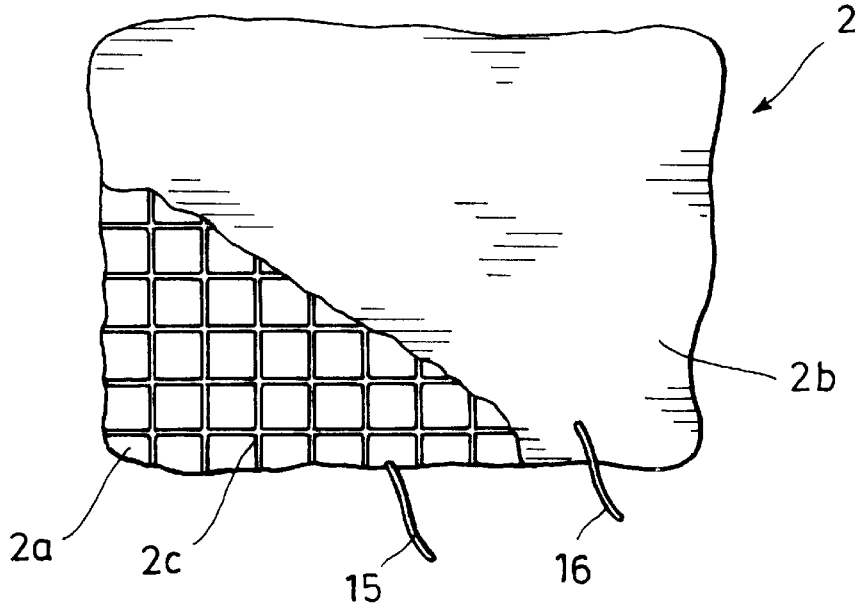
FIG. 1 shows a top view of a contact mat according to the invention, the upper plate being cut away in order to make the interlayer and the bottom plate visible.

In FIG. 1, reference numeral 2 generally identifies a contact mat, which has a section line at its periphery. This means that the mat can be arbitrary in its dimensions and that what is shown in FIG. 1 is only a portion in which the structure of contact mat 2 is visible. The contact mat 2 has plates 2*a* and 2*b*, which are made of rubber or polymers and rendered electrically conductive by the admixture of conductive substances such as carbon black, graphite, metal powder or the like. Connected to the plates 2*a* and 2*b* are electrical lines 15 and 16, which lead to a tactile sensor 1, so that the mat is a component of a device for closed-circuit protection, as is illustrated for example in FIGS. 3 and 4.

Plates 2*a* and 2*b* have a thickness of about 2.5 mm and are pliable. Reference numeral 2*c* identifies an interlayer, which is substantially inelastic and is made of nonconductive material, preferably a mesh fabric. The mesh fabric 2*c*, as can be seen in FIG. 1, has through openings so that, in the case of compressive loading of plate 2*b*, for example, the inner surface of this plate can make contact with plate 2*a* through the mesh openings and thus acts as an electric switch for the device for closed-circuit protection. The mesh width of the mesh fabric 2*c* is preferably about 5 mm. The thickness of the fabric is about 0.5 mm. The mesh fabric can, for example, be made self-adhesive on both sides so that, after the assembly of plates 2*a* and 2*b*, these plates are fastened to each other via the mesh fabric or interlayer 2*c*. The edges can be subsequently bound with an adhesive tape so that contact mat 2 is protected against the infiltration of dirt and the like. Contact mat 2 can, however, also be packed into a working mat, not illustrated, so that a mat results that can also be driven over with wheels and has an enhanced strength or protection.

Figure 2:
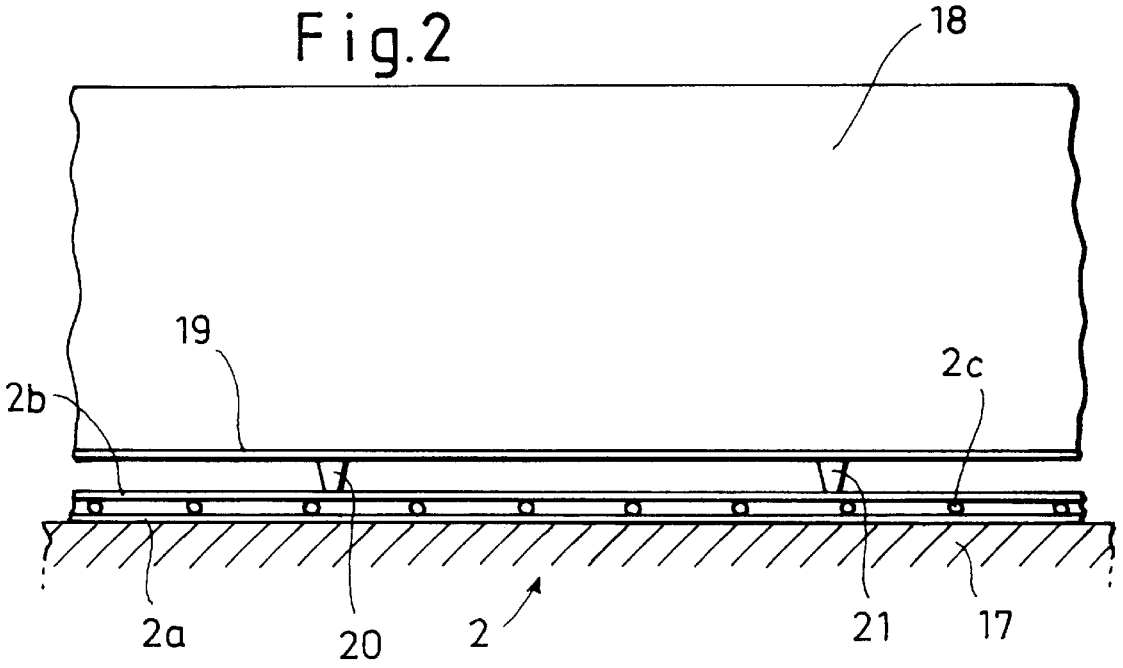
FIG. 2 shows a side view of an electrical contact mat with a support element arranged at a spacing therefrom and having an elastic superstructure.

In FIG. 2, the contact mat 2, again assembled from plates 2*a* and 2*b* and interlayer 2*c*, is supported on a rigid substratum 17 or on a mechanical part or on a vehicle. Arranged on the side of the mat lying opposite the substratum 17 is an elastic superstructure 18, which is attached to a support element 19, which in turn is in operative connection with the contact mat via transmission elements 20 and 21. If the elastic superstructure 18 encounters resistance, a force is exerted on the support element 19, which transmits this force to the plate 2*b* via transmission elements 20 and/or 21, so that plate 2*b* makes contact with the plate 2*a* and thus the mat acts as a switch in connection with the device for closed-circuit protection and initiates a switching pulse, which leads to a warning signal or a shutoff of the vehicle or of the machines and the like. The elastic superstructure is made so large in three dimensions and so elastic that the time between the switching pulse and the stopping of the machine or vehicle corresponds to a travel of the elastic compliance of superstructure 18 such that the machine or vehicle comes to a stop without damage occurring. Support element 19 must be free to move relative to the mat in a fashion parallel with the drawing plane of FIG. 2, in order that the forces can be transmitted and a switching pulse initiated. The support element, accordingly, can be, for example, suspended in hanging fashion or radially supported against the contact mat in a frame and movable in the drawing plane of FIG. 2 in such a way that the support element and the contact mat cannot separate from each other but can be pressed together.

By virtue of the distribution of the transmission elements between support element 19 and the contact mat, as well as their number and the size of the end of the transmission elements toward the contact mat, switching initiation can be varied and the reaction time and reaction force for the initiation of the switching pulse of the contact can be varied. Depending on the configuration of the transmission elements, oblique forces on the elastic superstructure can also initiate a switching pulse.

Figure 3:
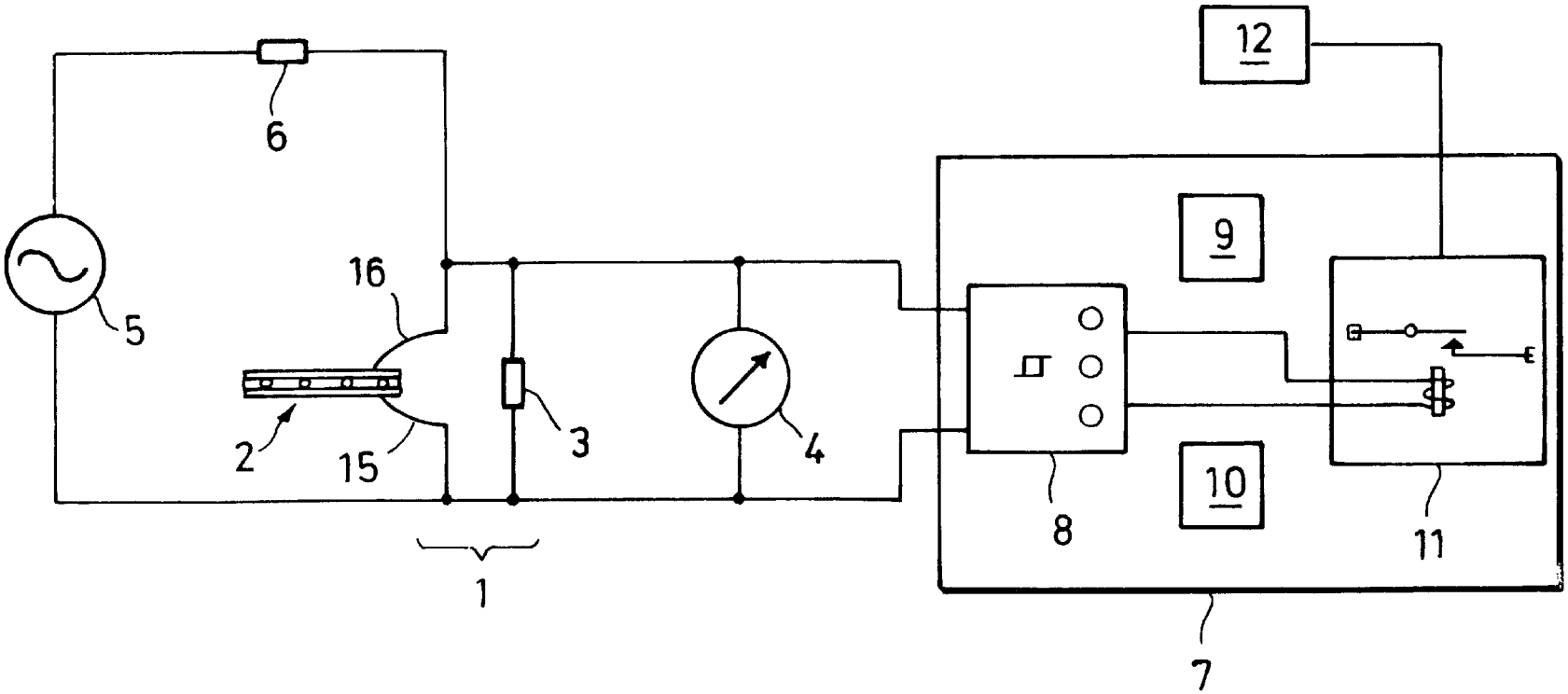
FIG. 3 shows a device for closed-circuit protection with a voltage source of an electrical contact mat used as the switch of a tactile sensor.

FIG. 3 shows a device for closed-circuit protection of the contact mat 2. The device has a tactile sensor 1, which includes the contact mat 2, which closes in the sense of a switch upon compressive loading, and an electrical resistance 3. Upon loading, for example stepping on switching mat 2, the resistance 3 is short-circuited and thus the current flow through the resistance 3 is altered, this change being detectable and interpretable. The voltage present across the resistance 3 (proportional to the current that flows through the resistance 3) can, if appropriate, be measured with a voltage measuring instrument 4 (voltmeter).

A voltage source 5 is provided in order to generate such a current through the closed circuit or such a voltage across resistance 3 that is maximally 1 volt. A series resistance 6 can, but need not, be provided for current limiting. The closed circuit is thus formed by the voltage source 5, the tactile sensor 1 and the series resistance 6, if present. If the series resistance 6 is present, the two resistances 3 and 6 form a voltage divider, so that the voltage of the voltage source 5 as a function of the voltage division ratio must be selected such that a constant, or as nearly constant as possible, voltage of maximally 1 volt is present across the resistance 3. The use of the voltage divider made up of resistances 3 and 6 has the advantage that the voltage across the resistance 3 can be set and maintained very exactly through the voltage division ratio by dimensioning of the resistances. In this way, the use of a very exact voltage source 5 is unnecessary. If appropriate, the series resistance 6 can also be designed as a variable resistance in order that the voltage across the resistance 3 with the switching mat open can be set very precisely with the aid of the voltmeter 4. A further advantage of the voltage divider is that the voltage fluctuations of the voltage source 5 have little or no effect on the voltage across the resistance 3.

The tactile sensor 1 is connected to an electronic interpretation unit 7, the voltage across resistance 3 first being led to a trigger 8. An electronic interpretation unit 7 includes a power supply 9 and a display unit 10 with which, for example, the operation, malfunctions and output signal of a trigger 8 and further quantities can be displayed. Furthermore, the interpretation unit 7 can include further elements that are necessary for operation but can be dispensed with for the description of the closed-circuit protection and hence are not illustrated.

The output signal of the trigger 8, which is designed, for example, as a Schmitt trigger, is led to a switching stage 11. As a function of the input signal, the trigger 8 operates in such a way that, for example, it emits no output signal and thus does not drive the switching stage 11 when the contact mat 2 is not actuated. If the contact mat 2 is actuated by its being compressed, the trigger 8 emits an output signal to the switching stage 11, which initiates a switching operation. Connected to the switching stage 11 (for example a relay, as shown in suggestive fashion in FIG. 1) is an actuator 12, which closes or opens, depending on the service. The actuator 12 can be an electric motor of a machine, which is shut off if a person steps on the contact mat.

Figure 4:
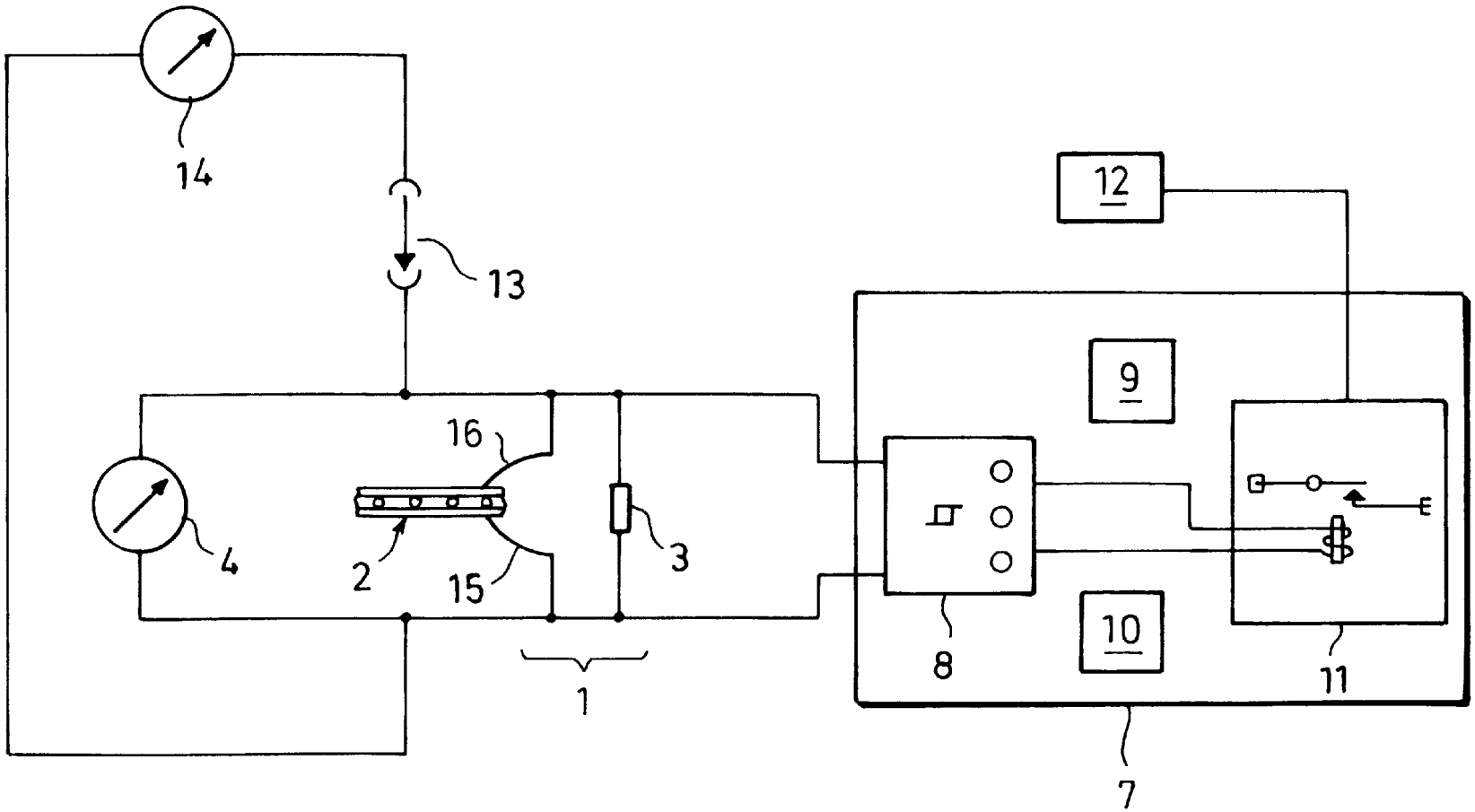
FIG. 4 shows a device for closed-circuit protection with a current source, in again the electrical contact mat performs as the switch of a tactile sensor.

FIG. 4 shows a device for closed-circuit protection with a current source. The current source 5 and series resistance 6 shown in FIG. 3 being replaced by a current source 13, which imposes a constant current in the resistance 3. This current is dimensioned such that, in dependence on the value of the resistance 3, the voltmeter 4 displays a maximal voltage of 1 volt, preferably a voltage lying in the voltage range from 0.2 to 0.8 volt. If the value of the imposed current should be important, it can be measured and displayed with a current measuring instrument 14.

It should be noted that the power supply 9 can be based on a line voltage of, for example, 220 volts AC, which is converted to a DC supply for the interpretation unit 7, so that a DC voltage is present for the device for closed-circuit protection. The device can, however, also be operated on AC, single-stage or multi-stage transformation being possible. It may, however, also be advantageous to provide a DC power supply the poles of which are interchanged at regular or also irregular time intervals in order to reverse the current flow at the contact points as well.

Relatively simple embodiments of devices for closed-circuit protection in conjunction with an electrical contact mat are shown in FIGS. 3 and 4. In order to enhance the reliability, it is conceivable to make one element or a plurality of the elements 20, 21 redundant, that is, preferably doubly redundant.

What is claimed is:

1. An electrical contact mat (2) providing closed circuit protection having at least two electrically conductive and flexible plates (2*a*, 2*b*) with confronting surfaces spaced from each other in an at-rest condition comprising:

an inelastic interlayer (2*c*) between said plates (2*a*, 2*b*) having openings of such size that said confronting surfaces of said plates (2*a*, 2*b*) make mutual contact when said contact mat (2) is under compressive load and a tactile sensor (1) having an electrical connection (3) in parallel with the contact mat (2), said contact mat (2) forming an electrical switch for said tactile sensor (1).

2. An electrical contact mat as set forth in claim 1 wherein said plates (2*a*, 2*b*) are thin and elastic switching elements.

3. An electrical contact mat as set forth in claim 1 wherein said interlayer (2*c*) is a nonconductive mesh fabric.

4. An electrical contact mat as set forth in claim 1 wherein said interlayer (2*c*) is made adhesive on both sides.

5. An electrical contact mat as set forth in claim 1 wherein said plates (2*a*, 2*b*) include protrusions arranged at intervals on their surface opposite said interlayer (2*c*).

6. An electrical contact mat as set forth in claim 1 having a bumper with large overtravel, including a support element (19), transmission elements (20, 21) attached to said support elements (19) and in contact with one of said plates 2*a*, 2*b* and an elastic superstructure (18) on the side of said support element (19) opposite said transmission elements (20, 21), said support element (19) being movable perpendicular to said plates 2*a*, 2*b*.

7. An electrical contact mat as set forth in claim 1 including a support strip with force transmission elements in thrust transmitting relation to one of said plates (2*a*, 2*b*) and wherein said contact strip is articulated so that it can move perpendicularly to said plates (2*a*, 2*b*).

8. An electrical contact mat as set forth in claim 1 wherein said tactile sensor (1) includes an electrical connection (3)

and wherein the current flowing in the closed circuit is variable through loading and unloading of the contact mat and this change initiates a switching operation, and further comprising equipment generating electrical current flowing in the closed circuit such that a voltage of maximally 1 volt is present across said electrical connection (3).

9. An electrical contact mat as set forth in claim 8, characterized in that a voltage in the range from 0.2 to 0.8 volt is present across said electrical connection (3).

10. An electrical contact mat as set forth in claim 9, wherein said equipment for generating the current flowing in the closed circuit is designed as a voltage source (5).

11. An electrical contact mat as set forth in claim 8 wherein said equipment for generating the current flowing in the closed circuit is designed as a current source (13) which imposes a current in said electrical connection (3) of said tactile sensor (1) to produce a voltage of maximally 1 volt.

12. An electrical contact mat as set forth in claim 8 including an electronic interpretation unit (7) having at least one trigger (8) and one switching stage (11), said tactile sensor (1) being connected to said interpretation unit (7).

* * * * *